US005242579A

United States Patent [19]

Mead et al.

[11] Patent Number: 5,242,579

[45] Date of Patent: * Sep. 7, 1993

[54] CONTROL METHOD FOR SOLVENT REFINING LUBRICATING OILS

[75] Inventors: Theodore C. Mead, Port Neches; Avilino Sequeira, Jr., Port Arthur, both of Tex.

[73] Assignee: Texaco Inc., White Plains, N.Y.

[ * ] Notice: The portion of the term of this patent subsequent to Aug. 13, 2008 has been disclaimed.

[21] Appl. No.: 678,089

[22] Filed: Apr. 1, 1991

[51] Int. Cl.[5] ..... C10G 53/06

[52] U.S. Cl. ..... 208/312; 208/322; 208/323

[58] Field of Search ..... 208/312, 322, 323

[56] References Cited

U.S. PATENT DOCUMENTS

| | | | |
|---|---|---|---|
| 2,261,287 | 11/1941 | Read | 208/312 |
| 4,053,744 | 10/1977 | Woodle | 208/33 |
| 4,311,583 | 1/1982 | Woodle | 208/312 |
| 4,328,092 | 5/1982 | Sequeira, Jr. | 208/326 |
| 4,419,226 | 12/1983 | Asselin | 208/322 |
| 4,866,632 | 9/1989 | Mead et al. | 208/87 |
| 5,039,399 | 8/1991 | Sequeira, Jr. | 208/322 |

*Primary Examiner*—Theodore Morris
*Assistant Examiner*—David M. Brunsman
*Attorney, Agent, or Firm*—Jack H. Park; Kenneth R. Priem; Richard A. Morgan

[57] ABSTRACT

In a solvent refining process a naphthenic lubricating oil feedstock is solvent extracted to yield a primary aromatics-lean raffinate and a primary aromatics-rich extract. Polynuclear aromatic content of primary raffinate is controlled by manipulating extraction temperature and solvent dosage. Primary extract is separated (settled) to form a secondary raffinate and a secondary extract. Secondary raffinate is recycled to solvent extraction. The refractive index of secondary raffinate is controlled by manipulating settling temperature and antisolvent dosage. The refractive index of secondary raffinate is maintained at or below the refractive index of feedstock. An improved yield of primary raffinate of a specified polynuclear aromatic content is achieved.

8 Claims, 1 Drawing Sheet

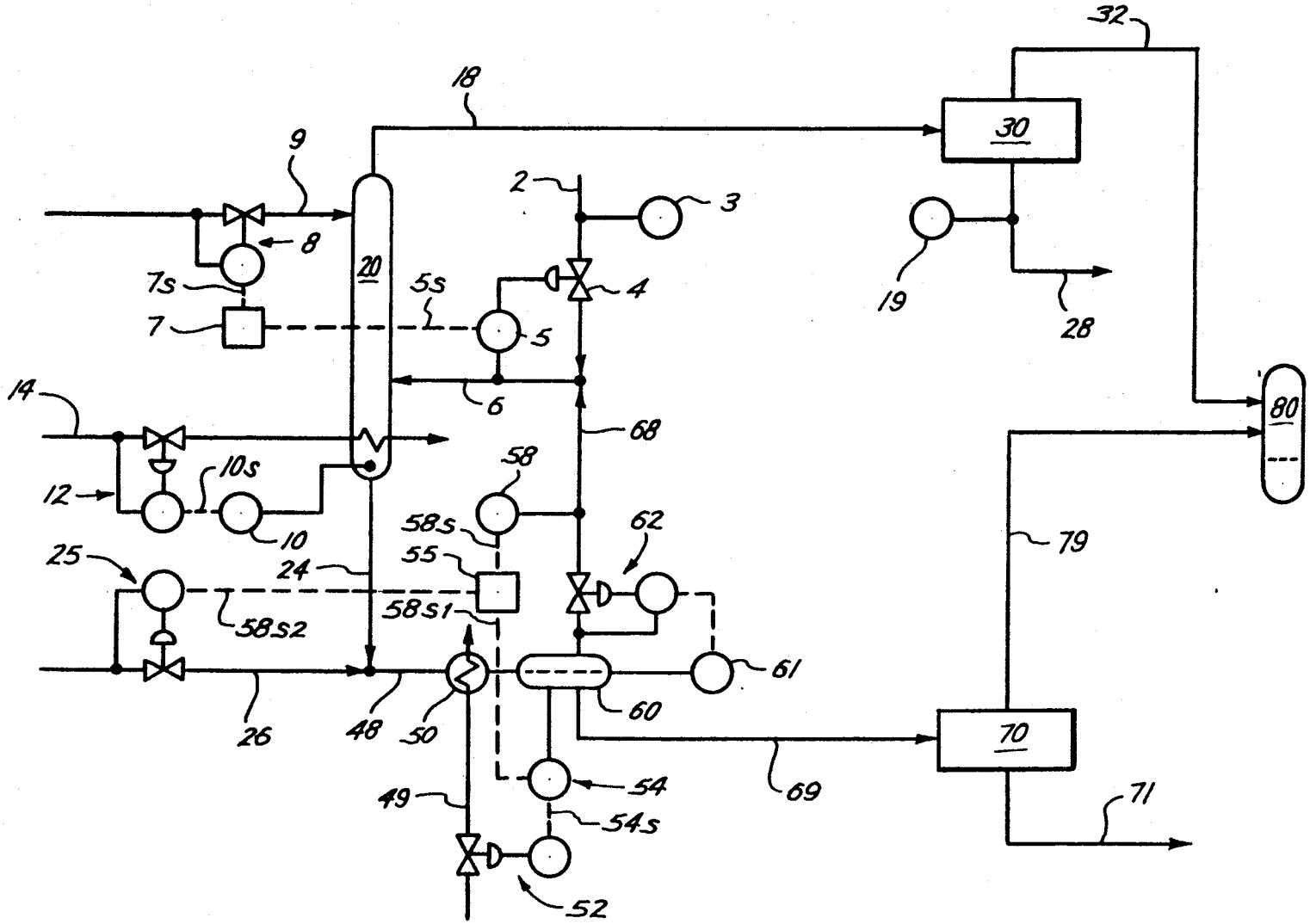
80
32
30
28
19
79
70
71
69
61
3
4
68
62
60
54
54s
52
2
5
6
58
58s
55
58s1
50
49
18
5s
20
48
9
8
24
10
58s2
26
7s
7
10s
14
12
25

CONTROL METHOD FOR SOLVENT REFINING LUBRICATING OILS

CROSS-REFERENCE TO RELATED APPLICATION

This application is related to application Ser. No. 07/678,087 filed on even date, for Control Method For Solvent Refining Lubricating Oils to T. C. Mead et al.

BACKGROUND OF THE INVENTION

1. Field Of The Invention

The invention relates to a control method for a solvent refining process. More particularly, the invention relates to solvent refining petroleum derived lubricating oil stocks to yield aromatics-lean raffinates and aromatics-rich extracts. Most particularly the invention relates to a control method for maximizing the yield of raffinate of a specified quality.

2. Description Of The Related Arts

It is well-known in the art to upgrade lubricating oil stocks. Upgrading typically involves treating these stocks with selective solvents to separate a relatively more aromatic fraction from a relatively more paraffinic fraction. In such a treatment, the preferred configuration comprises a countercurrent extraction process in which the lighter lubricating oil phase is introduced into the center or bottom section of the countercurrent extraction tower. The oil phase flows upwardly through the extraction tower and contacts downwardly flowing solvent which is introduced into the upper section of the extraction tower. A relatively paraffinic fraction, termed raffinate, is recovered from the top section of the extraction tower while solvent and relatively aromatic fraction, termed extract, are recovered from the bottom section of the tower.

Multistage solvent extraction processes are also known wherein either the raffinate phase, the extract phase or both are subjected to repeated extraction to enhance a d ®sired property.

U.S. Pat. No. 4,866,632 to T. C. Mead et al. teaches a control means and method for a solvent refining processing unit. An algorithm and control system are provided for optimizing the flow of charge oil to provide the maximum yield of extract oil of a specified quality, measured by refractive index. The invention is based on the discovery that when a charge oil is refined to yield a raffinate of given refractive index, the raffinate viscosity will be the same regardless of the refining temperature and solvent dosage.

U.S. Pat. No. 4,053,744 to R. A. Woodle teaches a control means for a solvent refining unit. The temperature of the extract mix in the solvent refining tower, the flow rate of the charge oil, the flow rate of the solvent and the flow rate of the extract oil are sensed and corresponding signals provided. The control means is operated in accordance with the signals to achieve either a maximum allowable flow rate for the solvent; a maximum allowable flow rate for the extract oil; a maximum allowable flow rate for the refined oil or a reduced charge oil flow rate for a fixed refined oil flow rate.

U. S. Pat. No. 4,328,092 to A. Sequeira, Jr. teaches a process for the solvent extraction of hydrocarbon oils. In the process N-methyl-2-pyrrolidone is the extraction solvent. The hydrocarbon oil is solvent extracted to form two phases, a secondary extract phase and a secondary raffinate phase. The secondary raffinate phase is returned to the extraction zone. As a result, an increased yield of refined oil product and a savings in energy is achieved.

U. S. Pat. No. 4,304,660 to A. Sequeira, Jr. discloses lubricating oils suitable for use as refrigeration oils. Those lubricating oils are produced by solvent extraction of naphthenic lubricating oil base stocks to yield an extract which is mixed with a solvent modifier and cooled to form a secondary raffinate and secondary extract. The secondary raffinate is treated with concentrated sulfuric acid and caustic neutralized to produce the refrigeration oil.

SUMMARY OF THE INVENTION

A control method has been discovered for solvent refining a naphthenic lubricating oil feedstock containing aromatic and non-aromatic components. The refractive index of the feedstock is measured. The lubricating oil feedstock is contacted in an extraction zone with an extraction solvent in a solvent/oil dosage in the range of 75 vol% to 500 vol% at an extraction temperature in the range of 100° F. to 250° F. An aromatics-rich primary extract and an aromatics-lean primary raffinate are withdrawn from the extraction zone.

The U.V. absorbance of the primary raffinate is measured. The extraction temperature and dosage are adjusted in response to the U.V. absorbance measurement to maintain it at a preselected value.

The primary extract is passed to a settling zone and cooled to a settling temperature 10° F. to 120° F. below the extraction temperature. About 0.0 vol% to 10 vol% antisolvent is added. As a result, two phases form consisting of a secondary extract phase richer in aromatics and a secondary raffinate phase leaner in aromatics. The secondary raffinate phase is separated and the refractive index measured. The settling temperature and antisolvent addition rate are controlled to maintain the secondary raffinate refractive index at a value less than or equal to the feedstock refractive index. Secondary raffinate is passed to the extraction zone with the fresh lubricating oil feedstock.

The invention is particularly useful for refining a naphthenic lubricating oil stock. In the furfural refining of naphthenic distillates, Environmental Protection Agency guidelines call for a primary extract-out temperature of at least 200° F. and solvent dosage of at least 130% to reduce polynuclear aromatic content in primary raffinate. Failing to meet minimum guidelines requires the labeling of the product as potentially hazardous, i.e. toxic to humans. It is desirable to comply with the guideline to avoid labeling the product. By use of the inventive control method, the yield of primary raffinate of the required U.V. absorbance is increased while maintaining the required primary extract-out temperature and solvent dosage.

DETAILED DESCRIPTION OF THE DRAWING

In the Drawing is a simplified diagram of a control system for controlling a solvent refining process.

A fresh naphthenic lubricating oil feedstock enters the system through line 2. The refractive index of this fresh feedstock is measured by analysis means 3. The flow rate of fresh feedstock into the process is controlled by flow control valve 4. Flow control valve 4 is adjusted by flow control means 5 comprising a flow rate indicator and controller. Flow control means 5 measures the total flow of feedstock entering primary extraction tower 20 through line 6 comprising fresh feedstock from line 2 and secondary raffinate from line 68.

The feedstock enters the primary extraction tower 20 at about the middle or below the middle of the tower. Extraction solvent is brought into the process through line 9 and enters the upper portion of primary extraction tower 20. The flow rate of extraction solvent is controlled by flow control means 8 comprising a flow control valve, flow rate indicator and controller.

Flow control means 5 provides signal 5*s* corresponding to flow rate through line 6 to ratio control means 7. Ratio control means 7 provides a set point signal 7*s* to flow control means 8 proportional to the flow through line 6.

Ratio control means provides for the flow rate of extraction solvent in amount of 75 vol% to 500 vol% of the flow of fresh feedstock plus recycled secondary raffinate to extraction tower 20.

Extraction solvent enters the upper portion of primary extraction tower 20. Extraction solvent comprises the sum of fresh solvent and recycled solvent. Recycled solvent may be brought into primary extraction tower 20 from solvent accumulator 110 after water removal (not shown) in accordance with maintaining solvent inventory balance.

In the primary extraction tower 20, the lubricating oil feedstock is intimately contacted countercurrently with an extraction solvent which has a preferential affinity for aromatic compounds compared to paraffinic compounds. Examples of such solvents are N-methyl-2-pyrrolidone, phenol and furfural which are used in the commercial petroleum refining industry for this purpose. As stated, extraction solvent is added in an amount relative to the flow rate of lubricating oil feedstock. On a percentage basis about 75 vol% to 500 vol% solvent is added relative to the lubricating oil feedstock, with a dosage in the range of 100 vol% to 300 vol% being typical. Extraction temperature is broadly in the range of 100° F. to 250° F. and pressure in the range of 0.5 atm to 10 atm.

Extraction temperature in extraction tower 20 is measured by temperature control means 10 comprising a temperature sensor, temperature indicator and controller. Temperature control means 10 provides set point signal 10*s* to flow control means 12 comprising a flow control valve, flow indicator and controller. Flow control means 12 controls the flow of cooling water or other temperature moderating medium through line 14 to extraction tower 20 to maintain extraction temperature in the range of 100° F. to 250° F. by indirect heat exchange.

As a result of the countercurrent contacting at solvent extraction temperatures and pressures, an aromatics-lean primary raffinate is passed from the top portion of primary extraction tower 20 through line 18 to primary raffinate recovery system 30. Primary raffinate recovery system 30 comprises any of the processes to remove raffinate from residual solvent. This may include, for example, distillation wherein a solvent free raffinate is distilled as a bottoms product and passed via line 28 to tankage. The overhead product of distillation is passed via line 32 to solvent accumulator 80. Primary raffinate recovery system 30 may alternatively be a second extraction stage wherein the primary raffinate is extracted with a second extraction solvent which is only slightly soluble in mineral oils and which is preferentially selective for the primary solvent as compared to the mineral oil. Such a solvent removal process is described in U.S. Pat. No. 2,261,799 to J. L. Franklin, Jr. incorporated herein by reference.

In the case of paraffinic feedstocks raffinate quality is defined as the concentration of nonaromatics in the stream. Raffinate quality is implicitly measured by refractive index or viscosity index. In this case, quality index is measured by analysis means 19 comprising a refractive index or viscosity index analyzer in line 28 and controller. In industrial practice this may be an on-line analyzer capable of providing an electronic set point signal (now shown) to temperature control means 10. In the alternative, analysis means 19 may be a laboratory analyzer. In this case, the set point signal is provided by an operating technician based on the refractive index or viscosity index measurement on the laboratory analyzer.

The invention is particularly useful in treating naphthenic oils. In the case of naphthene oils, solvent/oil dosage and temperature are more typically adjusted to achieve a reduced polynuclear aromatic content of 1 wt% or less for toxilogical considerations rather than refining to achieve a viscosity index. In this case, analysis means comprises a laboratory analyzer. Temperature and solvent dosage are adjusted by process technicians to maintain the required polynuclear reduction. Typically, temperature is set in the upper end of the operating range and the solvent dosage adjusted. For example, to meet EPA guidelines the temperature is set at 200° F. An initial solvent/oil dosage of 130/100 vol/vol is set. The polynuclear aromatics content is measured and the solvent/oil dosage reset to achieve 1 wt% or less.

The combination of analysis control means 19, temperature control means 10 and flow control means 12 provides for maintaining a desired raffinate quality by manipulating extraction temperature. The combination of flow control valve 4, flow control means 5, flow control means 8 and ratio control means 7 provides for maintaining raffinate quality by manipulating solvent dosage. Both control loops are adjusted by process technicians to achieved the desired polynuclear aromatic content of the solvent free primary raffinate.

An aromatics-rich primary extract in solution with extraction solvent is passed from the bottom of primary extraction tower 20 through line 24 and line 48 to primary extract cooler 50. Simultaneously, antisolvent such as water or wet extraction solvent is passed in an amount of 0.0 vol% to 10 vol%, preferably 0.5 vol% to 10 vol% through line 26 and also line 48 through primary extract cooler 50. Solvent accumulator 80 is a source of wet solvent. The combined streams are cooled by means of indirect heat exchange in cooler 50 to a temperature that is 10° F. to 120° F. below the temperature in primary extraction tower 20. The streams are passed together to decanter 60 where two phases spontaneously form. The upper phase is a secondary raffinate phase which is leaner in aromatics than the primary extract. The lower phase is a secondary extract phase which is richer in aromatics than primary extract and comprises a major proportion of the solvent.

The lower secondary extract phase is passed from decanter 60 through line 69 to extract recovery system 70 which comprises means for separating the aromatics-rich extract from extraction solvent. This separation means comprises flash towers and a stripper. A solvent free secondary extract is passed through line 71 to tankage for use consistent with its aromaticity. The solvent from the extract recovery system 70 is passed through line 79 to solvent accumulator 80 for retention and reuse in the process.

Secondary raffinate phase is passed through line 68 and line 6 to the primary extraction tower at a flow rate set by interface control means 61 cascading to flow control means 62 comprising a flow control valve in line 68, flow indicator and controller.

The control of cooling medium passed via line 49 to primary extract cooler is critical in controlling secondary raffinate quality. Secondary raffinate quality is defined by the nonaromatics content measured by the refractive index. The flow rate of cooling medium in line 49 is controlled by flow control means 52 comprising a flow control valve, flow indicator and controller. Temperature control means 54 comprising a temperature sensor, temperature indicator and controller, provides a signal 54*s* proportional to the difference between the actual settling temperature in decanter 60 and a set point signal. The set point signal 58*s* is provided by analysis control means 58, comprising means for analyzing the refractive index of secondary raffinate in line 68 and providing a corresponding signal and a controller for transmitting set point signal 58*s* to switch 55. The refractive index is normally corrected to account for about 10 vol% solvent. Switch 55 transmits signal 58*s*1 identical to signal 58*s* to temperature control means 54. The set point signal 58*s* is proportional to the difference between the measured refractive index and a desired (set point) value.

The desired quality of secondary raffinate is typically not achievable by means of settling temperature control alone. In this case the addition of antisolvent to decanter 60 via line 26 and line 48 is required. Antisolvent is added via flow control means 25 comprising flow control valve, flow indicator and controller. Switch means 55 is adjusted so that set point signal 58*s* is transmitted as signal 58*s*2 to flow control means 25. In this case, flow control means 52 is adjusted for the maximum flow of coolant through line 49 to primary extract cooler 50. Signal 58*s*1 is not transmitted by switch means 55 in this case.

Analysis control means 58 may be an on-line analyzer which in combination with an electronic controller provides set point signal 58*s*. In the alternative, analysis control means 58 may be a laboratory analyzer, the results from which are provided to an electronic or pneumatic controller to provide set point signal 58*s*.

The control system comprising analysis control means 58, temperature control means 54, flow control means 52, switch means 55 and flow control means 25 provide for controlling the quality of secondary raffinate at a desired value.

As a result of the recycle of secondary raffinate the flow of fresh feed supplied to primary extraction tower 20 through line 2 may be reduced. Criticality has been discovered in the quality of recycled secondary raffinate. If the refractive index of secondary raffinate measured by analysis control means 58 is maintained at a value less than or equal to the value of refractive index of fresh feed measured by analysis means 3, the yield of primary raffinate produced via line 28 is increased for naphthenic feedstocks at constant U.V. absorbance.

EXAMPLE 1

Three lubricating oil charge stocks were solvent extracted. The primary extract was subjected to cooling and a secondary raffinate withdrawn. No antisolvent was added. The refractive index and yield of solvent stripped secondary raffinate is reported.

| Stock | Settling Temp., °F. | Secondary Raffinate Refractive Index @ 70° C. | Yield, % of Primary Extract |
|---|---|---|---|
| Feedstock WD-7 | — | 1.4718 | — |
| WD-7 | 180 | 1.4494 | 44.7 |
| WD-7 | 150 | 1.4635 | 20.7 |
| WD-7 | 130 | 1.4645 | 27.3 |
| Feedstock WD-20 | — | 1.4810 | — |
| WD-20 | 180 | 1.4595 | 58 |
| WD-20 | 150 | 1.4749 | 10.4 |
| WD-20 | 110 | 1.4786 | 18.6 |
| Feedstock WD-40 | — | 1.4909 | — |
| WD-40 | 180 | 1.4665 | 67 |
| WD-40 | 150 | 1.4844 | 5.9 |
| WD-40 | 110 | 1.4862 | 9.2 |

Secondary raffinate quality (% nonaromatics) measured by refractive varies inversely with settling temperature. A significant amount of secondary raffinate can be recovered from primary extract. Even at the lowest settling temperature, the refractive index of secondary raffinate is lower than the refractive index of the feedstock. That is, the quality of secondary raffinate is sufficient to produce additional primary raffinate by reextraction.

The yield of secondary raffinate could have been increased up to the point where the refractive index of secondary raffinate equaled that of feedstock to produce additional primary raffinate.

EXAMPLE 2

A paraffinic feedstock was solvent extracted according to the inventive process. The improvement in yield of primary raffinate by recycle of secondary raffinate is reported.

| Stock | Settling Temp., °F. | Secondary Raffinate Refractive Index @ 70° C. | Secondary Raffinate Yield, % of Primary Extract | Yield Improvement, % |
|---|---|---|---|---|
| Feedstock WD-7 | — | 1.4718 | — | — |
| WD-7 | 180 | 1.4494 | 44.7 | — |
| WD-7 | 150 | 1.4635 | 20.7 | 12 |
| WD-7 | 130 | 1.4645 | 17.3 | 17 |
| Feedstock WD-20 | — | 1.4810 | — | |
| WD-20 | 180 | 1.4595 | 58 | |
| WD-20 | 150 | 1.4749 | 10.4 | 7 |
| WD-20 | 110 | 1.4786 | 18.6 | 13 |
| Feedstock WD-40 | — | 1.4909 | — | |
| WD-40 | 180 | 1.4665 | 67 | |
| WD-40 | 150 | 1.4844 | 5.9 | 4.2 |
| WD-40 | 110 | 1.4862 | 9.2 | 6.8 |

EXAMPLE 3

A naphthenic feedstock was solvent extracted according to the inventive process. The improvement in yield of primary raffinate by recycle of secondary raffinate is reported.

| Stock | Settling Temp., °F. | Refractive Index @ 70° C. | Yield, % of Primary Raffinate | Yield Improvement, % |
|---|---|---|---|---|
| Feedstock 55 Pale | — | 1.4784 | — | — |
| 55 Pale | 170 | 1.4631 | 81 | — |

-continued

| Stock | Settling Temp., °F. | Refractive Index @ 70° C. | Yield, % of Primary Raffinate | Yield Improvement, % |
|---|---|---|---|---|
| 55 Pale | 115 | 1.4760 | 15 | 14 min |
| Feedstock 100 Pale | — | 1.4864 | — | — |
| 100 Pale | 164 | 1.4725 | 68 | — |
| 100 Pale | 115 | 1.4850 | 14 | 11 min |
| Feedstock 300 Pale | — | 1.4895 | — | — |
| 300 Pale | 187 | 1.4710 | 77 | — |
| 300 Pale | 115 | 1.4832 | 12.3 | 10.4 min |

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A control method for solvent refining a hydrocarbon lubricating oil feedstock containing aromatic and nonaromatic components to yield a primary aromatics-lean raffinate comprising:

measuring a feedstock refractive index;

passing said feedstock to an extraction zone and contacting with extraction solvent at an extraction temperature in the range of 100° F. to 250° F. and a solvent to oil dosage in the range of 75 to 500 vol% thereby forming an aromatics-rich primary extract and an aromatics-lean primary raffinate;

separating and passing said primary extract to a settling zone;

cooling said primary extract in said settling zone to a settling temperature 10° F. to 120° F. below said extraction temperature, thereby forming two phases consisting of a secondary extract richer in aromatics and a secondary raffinate leaner in aromatics, separating said secondary raffinate and measuring a secondary raffinate refractive index, adjusting said settling temperature to maintain said secondary raffinate refractive index less than or equal to said feedstock refractive index, and passing said secondary raffinate to said extraction zone.

2. The control method of claim 1 wherein said hydrocarbon lubricating oil feedstock is a naphthenic lubricating oil stock.

3. The control method of claim 1 wherein said hydrocarbon lubricating oil feedstock is a naphthenic lubricating oil stock and said extraction temperature is adjusted to maintain a selected polynuclear aromatic concentration in said primary raffinate.

4. The control method of claim 1 wherein said hydrocarbon lubricating oil feedstock is a naphthenic lubricating oil stock and said solvent to oil dosage is adjusted to maintain a selected polynuclear aromatic concentration in said primary raffinate.

5. A control method for solvent refining a hydrocarbon lubricating oil feedstock containing aromatic and nonaromatic components to yield a primary aromatics-lean raffinate comprising:

measuring a feedstock refractive index;

passing said feedstock to an extraction zone and contacting with extraction solvent at an extraction temperature in the range of 100° F. to 250° F. and a solvent to oil dosage in the range of 75 to 500 vol% thereby forming an aromatics-rich primary extract and an aromatics-lean primary raffinate;

separately and passing said primary extract to a settling zone;

cooling said primary extract in said settling zone to a settling temperature 10° F. to 120° F. below said extraction temperature and adding antisolvent at an antisolvent flow rate, thereby forming two phases consisting of a secondary extract richer in aromatics and a secondary raffinate leaner in aromatics, separating said secondary raffinate and measuring a secondary raffinate refractive index, adjusting said antisolvent flow rate to maintain said secondary raffinate refractive index less than or equal to said feedstock refractive index, and passing said secondary raffinate to said extraction zone.

6. The control method of claim 5 wherein said hydrocarbon lubricating oil feedstock is a naphthenic lubricating oil stock.

7. The control method of claim 5 wherein said hydrocarbon lubricating oil feedstock is a naphthenic lubricating oil stock and said extraction temperature is adjusted to maintain a selected polynuclear aromatic concentration in said primary raffinate.

8. The control method of claim 5 wherein said hydrocarbon lubricating oil feedstock is a naphthenic lubricating oil stock and said solvent to oil dosage is adjusted to maintain a selected polynuclear aromatic concentration in said primary raffinate.

* * * * *